United States Patent [19]

Zeamer

[11] Patent Number: 4,854,128

[45] Date of Patent: Aug. 8, 1989

[54] CRYOGEN SUPPLY SYSTEM

[75] Inventor: Geoffrey H. Zeamer, Holliston, Mass.

[73] Assignee: Zeamer Corporation, Hopkinton, Mass.

[21] Appl. No.: 171,691

[22] Filed: Mar. 22, 1988

[51] Int. Cl.[4] ..... F17C 7/02

[52] U.S. Cl. ..... 62/50.1; 62/51.1

[58] Field of Search ..... 62/45, 50, 52, 54, 514 R

[56] References Cited

U.S. PATENT DOCUMENTS

| | | | |
|---|---|---|---|
| 2,538,664 | 1/1951 | Benz | 62/54 |
| 3,097,497 | 7/1963 | Fitt | 62/52 |
| 3,861,161 | 1/1975 | Cooper | 62/50 |
| 4,348,873 | 9/1982 | Yamauchi et al. | 62/52 |
| 4,575,386 | 3/1986 | Hamers | 62/54 |

*Primary Examiner*—Ronald C. Capossela

*Attorney, Agent, or Firm*—Fish & Richardson

[57] ABSTRACT

A cryogen supply system for supplying either gaseous state cryogen or liquid state cryogen. The cryogen supply system includes a thermally insulated fluid container for holding a volume of cryogenic liquid. A gas inlet port is formed in the fluid container so that gas from an external source can be introduced therein. Inside the fluid container is a cooling module having a gas inlet opening for receiving gas introduced into the fluid container. The gas that flows into the gas inlet opening flows into a heat exchanger located at the base of the fluid container. The heat exchanger is connected to a manifold that, in turn, is connected to an outlet line. A liquid inlet line, having a liquid inlet opening in the base of the fluid container is also connected to the manifold. Gas flow from the heat exchanger to the manifold and from the liquid intake to the manifold is controlled by appropriate valve means. The outlet line is connected to a heating module in which the fluid flowing through may be heated to a selected temperature. The pressure of the gas introduced into the fluid container forces gas into the inlet line and the heat exchanger, where it is cooled to a temperature at or just above that of the cryogenic liquid, and also forces cryogenic liquid into the liquid inlet line.

16 Claims, 6 Drawing Sheets

CRYOGEN SUPPLY SYSTEM

FIELD OF THE INVENTION

This invention relates generally to the field of cryogenics, and in particular provides a cryogen supply system that can supply a cryogenic fluid at selected temperatures and that can be used to supply both liquid state and gaseous state cryogen.

BACKGROUND OF THE INVENTION

There is an increasing need to provide very cold liquids and very cold gases, generally referred to as cryogens, for industrial and scientific applications. Typically, a cryogen is supplied to a cryostat or other cooling device where it is used as a heat sink to extract thermal energy from a sample in order to cool the sample to a very low temperature. The need to provide cryogens has developed because of the growing interest in desirable properties that are observed in some substances when they are cooled to very low temperatures. One such property is super conductivity, which is a substance's ability to conduct electrical current with minimal internal resistance. To date, super conductivity has been observed in some substances only when they are cooled to very low temperatures.

Currently, most cryogen supply systems are designed to provide cryogen in either a liquid state or a gaseous state. Cryogen supply systems for liquefied state cryogens typically are dewars or other insulated containers that are used to store the cold liquid prior to its delivery to an end use device. These supply systems usually rely on some type of mechanical mechanism to pump the liquid through a supply line to the end use device.

Cryogen supply systems for gaseous state cryogens usually include a sealed dewar or other container for holding liquid state cryogen that has a heating element located in the cryogen containment space. Cryogenic gas is generated by boiling the liquid state cryogen to produce the gas. The gas pressure that develops inside the container as a consequence of the generation of the gas is sufficient to force the gas through a supply line to the end use device.

There are a number of limitations and disadvantages associated with the currently available cryogen supply systems. The mechanical pumps used with liquid state cryogen supply systems are complicated to operate, expensive and can be noisy. Gas state cryogen supply systems must be refilled with liquid state cryogen when they inevitably run dry. The time spent refilling the cryogen supply system with the supercooled liquid interrupts the time the system can be used to supply cryogenic gas. In other words, current gas state cryogenic gas systems cannot readily be used to provide an uninterrupted supply of cryogen for extended periods of time.

Another disadvantage of available gas state cryogen supply systems is the need to have a readily available supply of liquid state cryogen on hand when gas state cryogen supply systems are being used to supply large amounts of cryogen and/or being used to supply cryogen for extended periods of time. In some situations it is difficult to provide sufficient storage place for the needed cryogenic liquid. Moreover, there may be significant costs associated with storing the liquid.

Many current cryogen supply systems are not able to provide cryogenic fluid that, while cold, is at a temperature above that at which it is stored in the supply system. Liquid state cryogen supply systems usually cannot be used to provide cryogenic liquid at temperatures above that at which it is stored in the system. Gaseous state cryogen supply systems may be useful in providing a super cooled gas that is just above its condensation temperature, but cannot be readily used for providing a gas, though cold, is at a significantly higher temperature than the temperature at which it evaporates. This limitation makes it difficult to provide cryogens at selected temperatures above the temperatures of the cryogens stored in the supply system.

Furthermore, there is often a need to supply gaseous state and liquid state cryogen to the same cooling device. This need arises, for example, when it is desirable to cool a sample to a number of different temperatures in order to observe the changes that may occur as its temperature changes. In these situations it is desirable to provide a cooling device with a super cooled liquid at one temperature, and then immediately thereafter with a super cooled gas, that is typically at a temperature above that of super cooled liquid. To date, it has proved difficult to provide a cryogen supply system that can simply and quickly be used to both cryogenic liquid and cryogenic gas.

SUMMARY OF THE INVENTION

This invention provides a new and improved cryogen supply system that can be used to continuously provide gaseous state cryogen for extended periods of time, that can be used to supply cryogenic fluid at selected temperatures, and that can be used to supply either gaseous state cryogen or liquid state cryogen.

In brief summary, the new cryogen supply system of this invention comprises a dewar with a fluid container for storing cryogenic liquid. The dewar includes a gas inlet port for introducing gas into the fluid container. Inside the fluid container is a cooling module with a heat exchanger at the base of the container which receives gas from a gas inlet opening inside the container. Gas is supplied to the heat exchanger from a gas inlet opening located above the liquid state cryogen fill line. The cooling module also includes a liquid inlet opening located in the bottom of the fluid container. The heat exchanger and the liquid inlet opening are connected to a common manifold that is connected to an outlet line. Fluid flow from the heat exchanger and liquid inlet opening into the manifold is controlled by separate gas control and liquid control valves. The outlet line is connected to a heating module with selectively energizable heating elements and a set of temperature sensors so that the cryogenic fluid may be heated as it flows therethrough. The heating module includes an outlet coupling through which cryogen is discharged from the supply system.

The cryogen supply system is used by initially filling the fluid container with a cryogenic liquid of the type the system is being used to supply. After the dewar is filled with the liquid, gas, with a composition identical to that of the cryogenic liquid, is supplied to the dewar through the gas inlet port. The pressure of the gas in the containment space forces the gas into the gas inlet opening and to the heat exchanger where it is cooled to a temperature just above that of the cryogenic liquid. The gas control and liquid control valves are used to control the flow of cryogenic fluid through the manifold and the outlet line. If gaseous state cryogen is desired, the gas control valve is opened allowing the cryogenic gas to flow through the manifold to the outlet line. If liquid state cryogen is desired, the liquid control valve is opened, and the gas pressure in the fluid chamber forces the liquid through the liquid opening, and the manifold and into the outlet line. The cryogen discharged through the outlet line enters the heating module where it is heated to a selected temperature by the heating elements in response to signals generated by the temperature sensors. The cryogen is then discharged from the supply system at the desired temperature.

The cryogen supply system cools ambient temperature gas from an external source so that the gas, in turn, can be used by cooling devices to cool samples to very low temperatures. The cryogen supply system is used. An external gas supply system that can supply a continuous flow of gas to the cryogen supply system can be provided with a minimal amount of effort and expense. Thus, the cryogen supply system can readily be adapted to provide an uninterrupted flow of gaseous state cryogen for extended periods of time.

Moreover, when the cryogen supply system is used primarily to supply gaseous state cryogen, there is no need to have large amounts of extra liquid state cryogen readily available. This eliminates the storage considerations and expenses associated with having to keep significant amounts of super cooled liquid readily available.

In the cryogen supply system, the gas supplied to the system forces the liquid state cryogen through the outlet line and heat exchanger for discharge through the outlet coupling. Thus, the cryogen supply system can be used to deliver liquid state cryogen without the use of mechanical pumps that can be complicated to use, expensive and noisy.

The cryogen supply system can be used to supply a cryogen that is heated to a temperature above the temperature in the fluid chamber. The cryogen supply system can readily supply either gaseous state cryogen, liquid state cryogen, or a combination thereof, by simply adjusting the gas control and the liquid control valves.

Still other advantages of this cryogen supply system are that it is relatively compact, economical to manufacture, economical to operate, and that it is relatively simple to use.

BRIEF DESCRIPTION OF THE DRAWINGS

This invention is pointed out with particularity in the claims. The above and further advantages of this invention may be better understood by referring to the following description taken in conjunction with the accompanying drawings, in which:

DETAILED DESCRIPTION OF THE PREFERRED EMBODIMENTS

Figure 1:
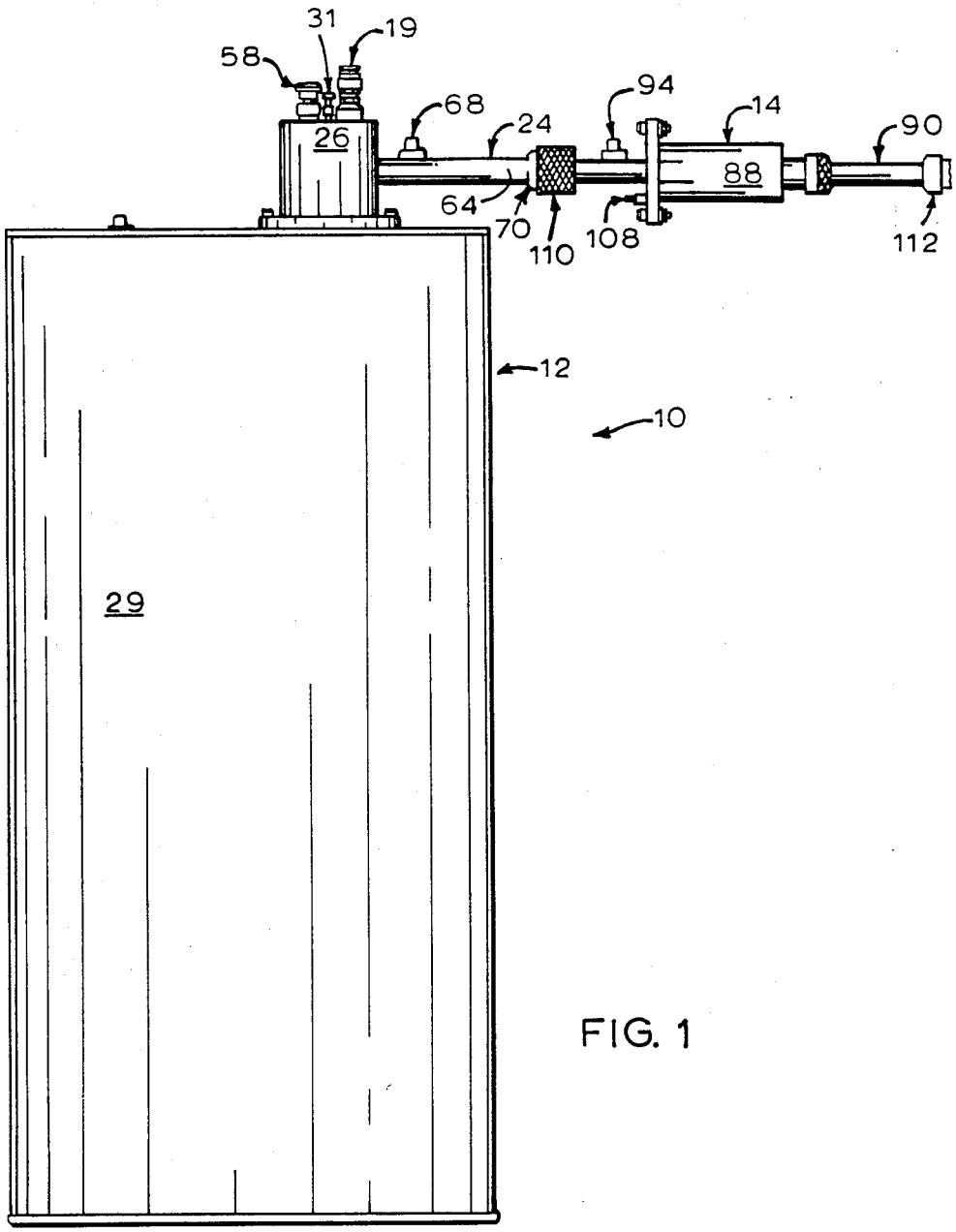
FIG. 1 is a side plan view of a cryogen supply system constructed in accordance with this invention.
Figure 2:
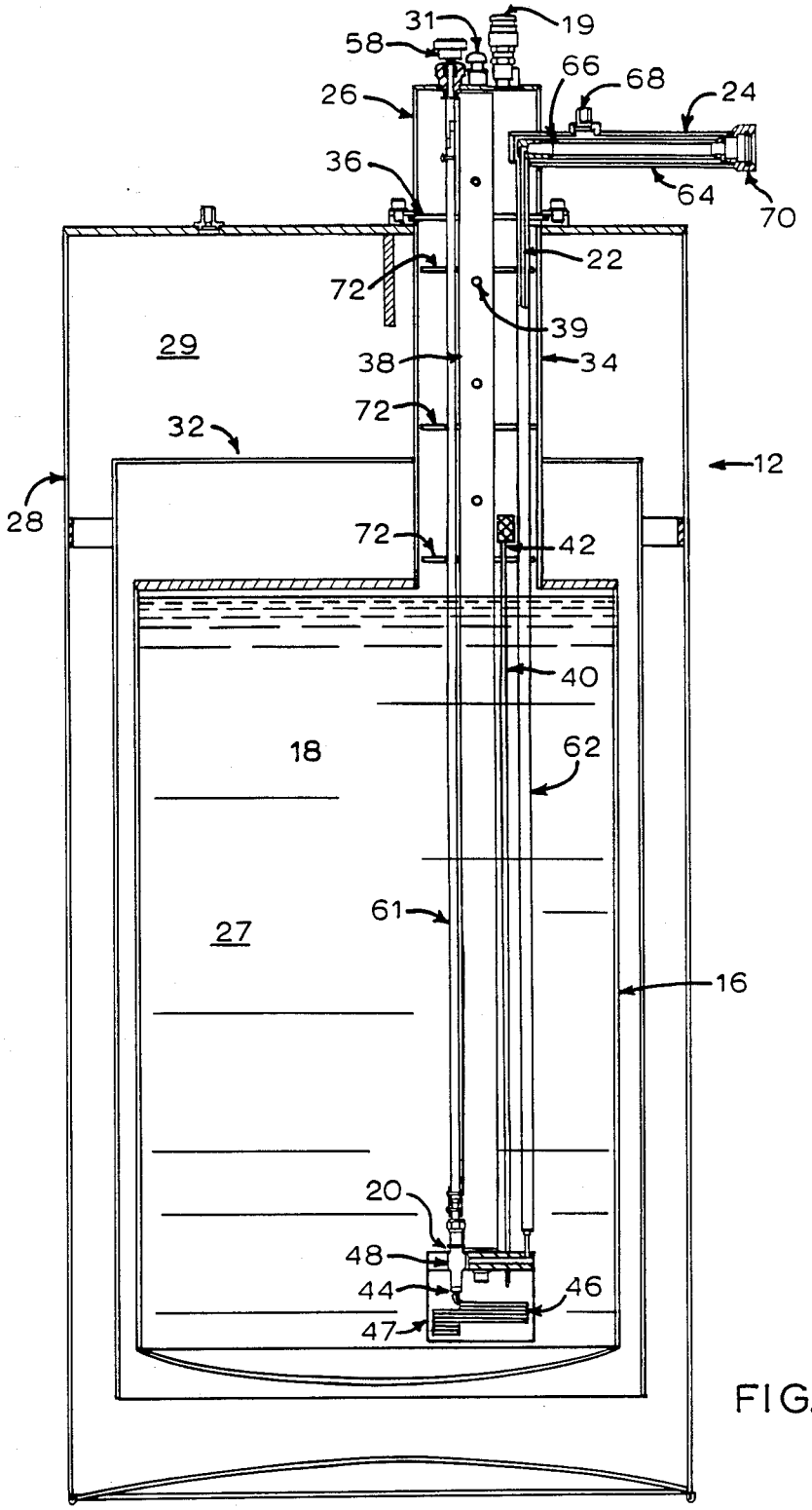
FIG. 2 is a partial cross-sectional view of a dewar of the cryogen system of FIG. 1.
Figure 3:
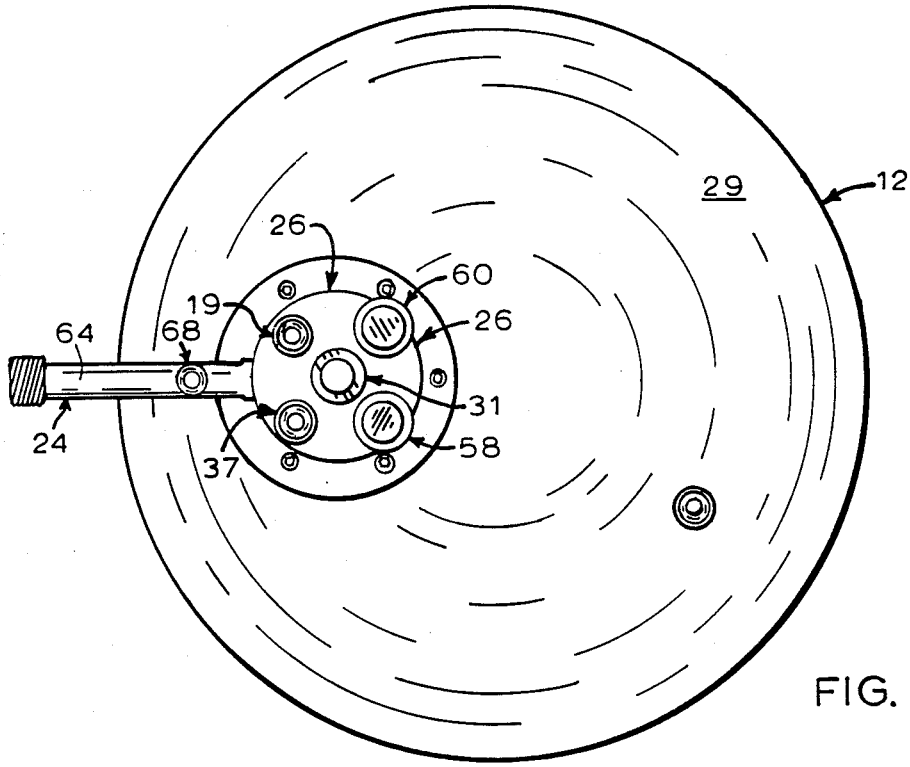
FIG. 3 is a top plan view of the dewar of the cryogen supply system depicted in FIG. 1.

FIGS. 1 through 3 depicts a cryogen supply system 10 constructed according to this invention comprising a cylindrically shaped dewar 12 from which cryogen is supplied. The cryogen generated in the dewar 12 may be heated by a heating module 14 to a selected temperature as it flows therethrough from the dewar 12. As depicted in FIG. 2, the dewar 12 includes a vacuum-insulated fluid container 16 for holding cryogenic liquid 18. Gas, of the same composition as the cryogenic liquid 18, is supplied to the fluid container through a gas supply port 19. A cooling module 20, located in the fluid container 16, supplies either gaseous state or liquid state super cooled fluid from the container 16 to an insulated outlet line 22 connected thereto. The outlet line 22 is connected to a discharge coupling 24 attached to a head 26 on the top of the dewar 12. The heating module 14 is attached to the outlet coupling 24 and is adapted to receive the super cooled fluid discharged therefrom.

The dewar 12 includes the fluid container 16 that defines a fluid containment space 27 in which the cryogenic liquid 18 is held. The fluid chamber 16 is housed in a dewar outer shell 28 and spaced away therefrom so as to define a thermally insulating vacuum space 29 therebetween. A vacuum port 30 is formed on the dewar outer shell 28 so that a vacuum may be drawn therethrough on space 29. Cryogenic liquid 18 is introduced into the fluid containment space 27 through a normally capped liquid fill line 31 connected between the shell 28 and the fluid container 16. In the illustrated embodiment, the liquid fill line 31 comprises a normally capped opening in the top of the head 26. A radiation shield 32 is contained within the vacuum space 30 such that the shield 32 covers substantially all of the top and outer surfaces of the fluid chamber 16 so as to block heating of the chamber 16 or fluid therein by incoming thermal radiation.

A gas duct 34 provides access to the fluid containment space 27 through an opening 36 formed in the top of the dewar's outer shell 28. Opening 36 is normally sealingly covered by the head piece 24. The gas supply port 19 is mounted on the head piece 24 so that the gas is introduced into the gas duct 34. A pressure relief valve 37 (FIG. 3) is provided in the head piece 24 so that the fluid containment space 27 and gas duct 34 may be vented to prevent an explosion.

Figure 5:
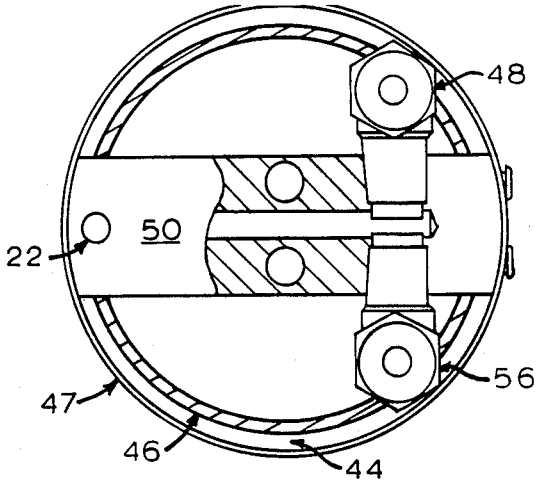
FIG. 5 is a top plan view of the cooling module of the cryogen supply system of this invention illustrating it gas control valve, liquid control valve and manifold.

The cooling module 20 is suspended from the headpiece 24 by a fiberglass tube 38 that extends through the duct and into the fluid chamber 16. Openings 39 are formed in the tube 38 so that the gas pressure inside the tube is at equilibrium with respect to the gas pressure outside of the tube 38. Gas is introduced into the cooling module 20 through a gas intake line 40 with an opening 42 located in the gas duct 34 above the fluid containment space 27. A filter 43 covers the gas inlet line opening 42 to prevent contaminants from entering the gas inlet line 40. Gas flows through the gas intake opening into a heat exchanger 44 located in the base of the fluid container 16. The heat exchanger 44, best seen by reference to FIGS. 4 and 5, comprises a number of small, thermally conductive tubes 46 formed in the shape of a helix and that are surrounded by an elongated ring 47 of thermally conductive metal. The heat exchanger tubes extend from the gas intake line 40 to a gas control valve 48 that regulates the flow of gas from the heat exchanger tubes 46 into a manifold 50 to which it is connected.

Figure 4:
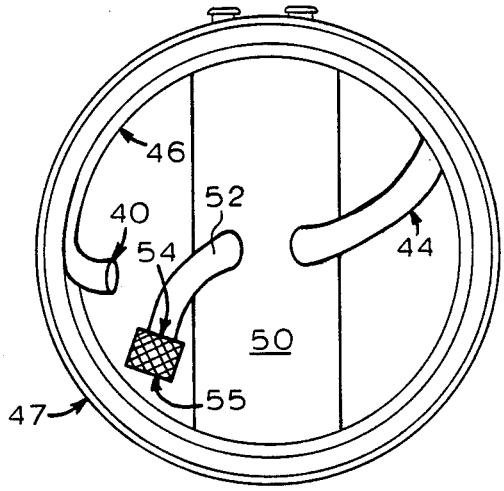
FIG. 4 is a bottom plan view of a cooling module of the cryogen supply system of this invention illustrating a heat exchanger and a liquid intake.

Cryogenic liquid 18 is introduced into the manifold 50 through a liquid inlet line 52 connected thereto, as best seen by FIG. 4. The liquid state super cooled fluid 18 enters the liquid inlet line 52 with a liquid inlet opening 54 located in the center of the helix formed by the heat exchanger tubes 46. A filter 55 covers the liquid inlet opening so as to prevent the flow of contaminants therethrough. Liquid flow from the liquid inlet line 52 into the manifold is controlled by a liquid control valve 56 between the line 52 and the manifold 50.

The gas control valve 48 and liquid control valve 56 are respectively controlled by a gas control knob 58 and a liquid control knob 60 on the head 26. Valve stems 61 that extend through the gas duct 34 and the containment space 27 provide a linkage between the control knobs 58 and 60 and their respective valves 48 and 56.

The outlet line 22 is connected to the cooling module manifold 50 and adapted to receive fluid therefrom. The outlet line 22 extends from the manifold through the fluid containment space 27 and the gas duct 34 into the head 26 where it is connected to the outlet coupling 24. The outlet line 22 and the outlet coupling 24 are each encased in separate outer jackets, identified respectively by reference numbers 62 and 64. The outlet line outer jacket 62 and outlet coupling outer jacket 64 are spaced from the outlet line 22 and the outlet coupling 24 and are connected to each other so as to create a single thermally insulating vacuum space 66 around the outlet line 22 and the outlet coupling 24. A vacuum port 68 on the outlet coupling outer jacket 64 is provided so a vacuum may be drawn on the vacuum space 66. A connecting piece 70 is located at the end of the outlet coupling 24.

The fluid chamber is insulated from radiational heating by the radiation shield 32 and by several disk shaped radiation shields 72 located in the gas duct 34. The radiation shields 72 are each formed with a number of openings (not shown) so that the outlet line 22, the fiberglass tube 38, and the valve stems 60 may extend therethrough. The radiation shields 72 are dimensioned to allow gas to flow from the gas supply port 19 to the gas intake opening 42 and the fluid containment space 27.

Figure 6:
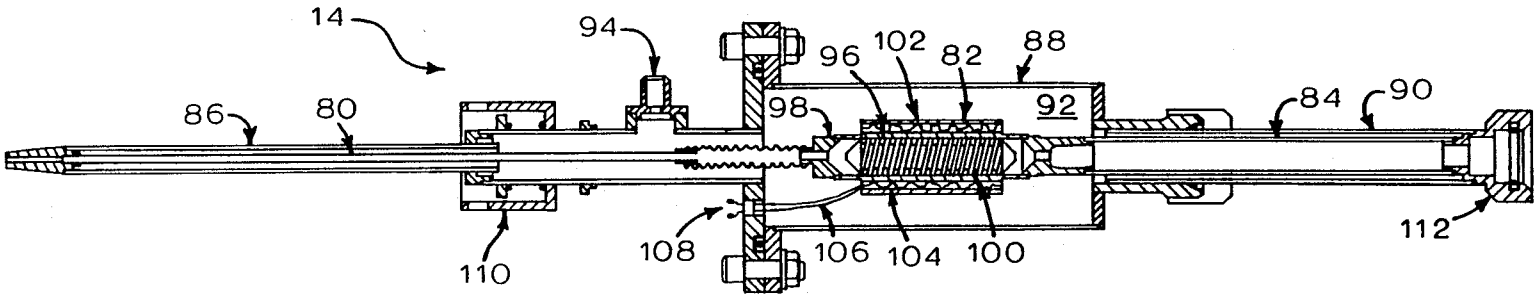
FIG. 6 is a partial cross-sectional view of a heating module of the cryogen system of FIG. 1.

Gas enters the heating module 14, illustrated by FIG. 6, through an inlet line 80, flows through a heating unit 82, and is discharged from an outlet line. The inlet line 80, the heating unit 82, and the outlet line 84 are each encased in separate vacuum jackets identified respectively by reference numerals 86, 88, and 90. The vacuum jackets 86, 88, and 90 are connected together to form a single, thermally insulating vacuum space 92 that extends the length of the heating module 14. A vacuum port 94 is provided on the inlet line vacuum jacket 86 so that a vacuum may be drawn on the vacuum space 92.

The heating unit 82 includes a thermally conductive core 96 encased in a shell 98 connected to receive cryogen from the inlet line 80. Formed in the outside wall of the core 94 are a pattern of helical grooves 100 the cryogen flows through as it passes through the shell 98. Housed in the shell 98 are a set of electrically energizable heating elements 102 for heating the cryogen and a set of temperature sensors 104 for monitoring the cryogen's temperature. Conductors 106 which carry signals from the temperature sensors 104 and current to the heating elements 102 extend from a set of terminals 108 on the outside of the heating unit vacuum jacket 88. A connector 110, with a double seal, is located over the inlet line vacuum jacket 86, that can be used to form a gas-tight seal with the dewar outlet coupling connector 70. An appropriate connector 112 is located on the end of the heating module outlet line 84.

The cryogen supply system 10 is used by initially connecting the heating module 14 to the dewar 12, connecting an appropriate outlet line for receiving the cryogen from the heating module outlet line 84, and filling the fluid containment space with the appropriate cryogenic liquid 18. Gas, with a composition similar to that of the cryogenic liquid 18, is then introduced into the dewar through the gas supply port 19 so that the fluid containment space 27 and gas duct 34 are pressurized. The gas control valve 48 and liquid control valve 56 are then set so cryogenic fluid of the appropriate state is discharged from the dewar 12. That is, if gaseous state cryogen is desired, the gas control valve 48 is opened and the gas pressure forces the gas through the gas intake opening 42 and the gas intake line 40 and through the heat exchanger 44 where it is cooled to a temperature at or just above that of the cryogenic fluid 18. The gas then flows from the heat exchanger 44 through the manifold 50 into the outlet line 22. On the other hand, if liquid state cryogen is desired, the liquid control valve 56 is opened and the gas pressure in the fluid containment space 27 forces the cryogenic fluid 18 through the liquid inlet opening 54 so that flows through the liquid control valve and the manifold 50 and the outlet line 22 and is discharged through the outlet coupling 24.

The gaseous state or liquid state cryogenic fluid discharged through the dewar outlet coupling 24 flows through the heating module 14. A remote processor (not shown) connected to the heating unit 82 responds to the signals generated by the temperature sensor 104 to selectively energize the heating elements 102. As the cryogen flows through the grooves 100 formed in the core 94, the heat generated by the heating elements 102 warms the cryogen to a desired temperature. The cryogen is then discharged from the heating module 14 through the outlet line 84.

The cryogen supply system 10 is supplied with gas from external sources such as gas tanks that can be readily replaced and are economical to provide. With minimal effort and expense a gas supply system can be provided that continually supplies gas to the cryogen supply system 10 for cooling and final discharge as a super-cooled fluid. Thus, this cryogen supply system 10 can be used to provide an uninterrupted flow of gaseous state cryogen for extended periods of time.

Moreover, only unchilled gas is needed to refill the cryogen supply system 10 when it is being used to supply gaseous state cryogen. Consequently, there is no need to have supplies of liquid state super cooled fluid readily available when the system 10 is used to generate gaseous state cryogen.

The cryogen can be heated as it flows through the heating module 14 prior to its discharge from the supply system 10. Thus, the cryogen supply system 10 can be used to supply a cryogen at a temperature above the temperatures normally associated with the cryogen. This feature is useful for supplying cryogen for cooling samples to low temperatures that are above the lowest temperatures the cryogen can be used to cool the samples to.

The cryogen supply system 10 can be used supply either gaseous state cryogen or liquid state cryogen by simply setting the gas control valve 48 and the liquid control valve 56. This makes it possible to readily change between diverse cryogenic fluids in a minimal amount of time.

Gas pressure is used to discharge cryogen from the dewar 12 and through the heating module 14 so that it can be supplied to the device for which it is intended. Thus, the cryogen system 10 supplies cryogen without the difficult to operate, expensive, and sometimes noisy mechanical pumps associated with other cryogen supply systems.

Another advantage of the cryogen supply system is that it is a relatively compact unit. In one specific embodiment, the dewar 12 is approximately 4 feet high and occupies a little less than 16 cubic feet of space. The heating module 14 is approximately 2 feet long and has a cross-sectional area of less than one half square foot. The cryogen supply system 10 is economical to provide and can be used to supply cryogenic gas for extended periods while being supplied with inexpensive ambient temperature gas.

Figure 7:
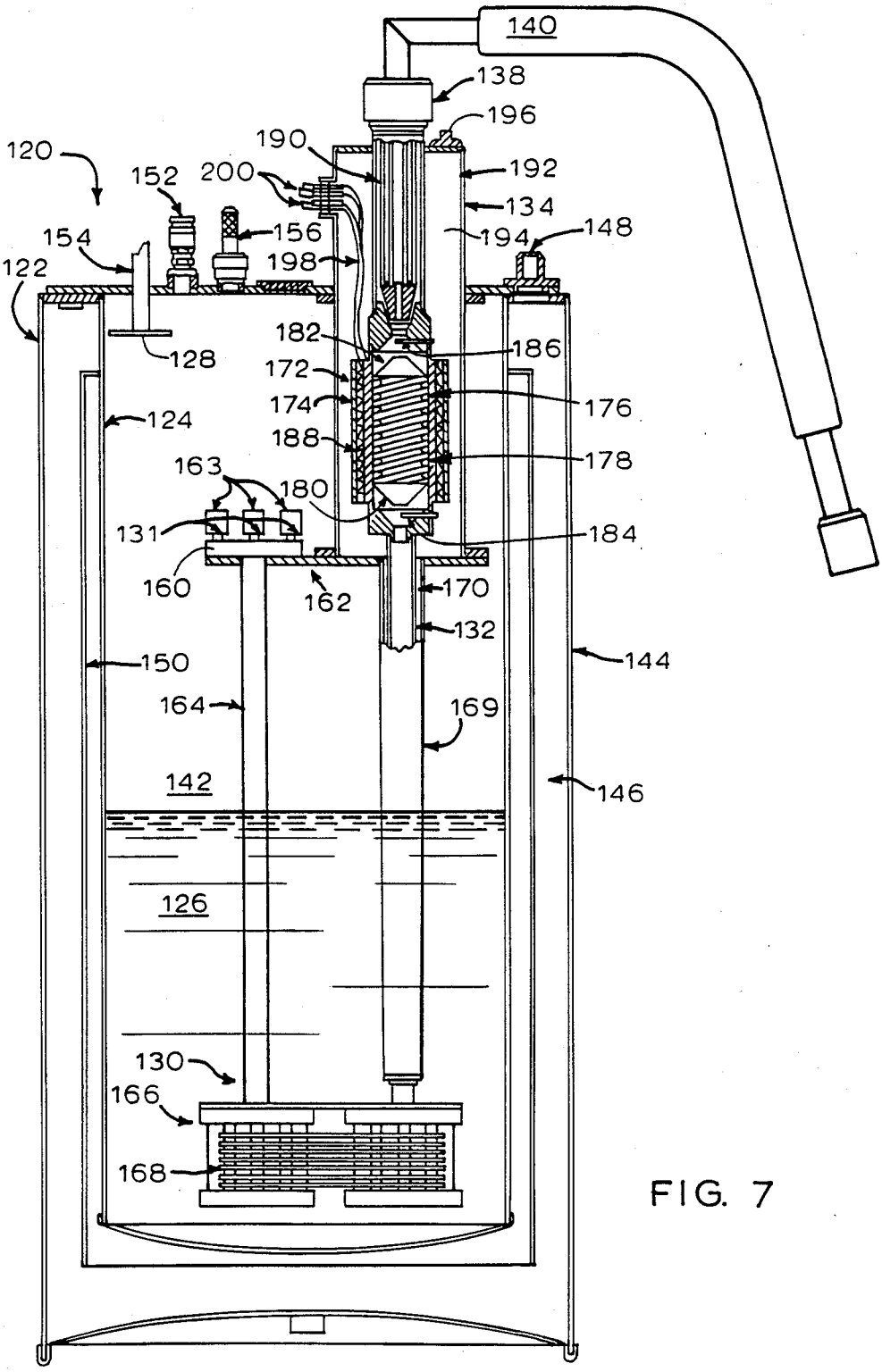
FIG. 7 is a partial cross-sectional view of an alternate embodiment of the cryogen supply system of this invention.

An alternative embodiment of this invention is depicted in FIG. 7, which shows a cryogen supply system 120 housed in a dewar 122 and including a fluid container 124 for holding cryogenic liquid 126. Formed in the dewar is a gas inlet port 128 through which gas from an external source is introduced into the fluid container 124. Inside the fluid container 124 is a cooling module 130 for receiving the gas introduced into the container 124 through gas inlet openings 131 and cooling it to a temperature just above that of the cryogenic fluid 126. Gas is discharged from the cooling module 130 through an outlet line 132 connected to a heating module 134 attached to the top of the dewar 122, which, in turn, can be used to heat the gas as it flows there through. Gas flows from the heating module 134 to an outlet coupling 138 connected thereto. The outlet coupling is adapted to provide a gas-tight connection to an appropriate line 140 through which the gas is supplied to the end use device it is intended for.

The dewar 122 includes the fluid container 124 that defines a fluid containment space 142 in which the cryogenic liquid 126 is held. A dewar outer shell 144 surrounds the fluid container 124 and is spaced apart therefrom so as to define a thermally insulating vacuum space 146 therebetween. A vacuum port 148 is formed in the base of the dewar outer shell 144 through which the vacuum space 146 may be evacuated. A radiation shield 150 is mounted around the outside wall of the fluid container 124 in the vacuum space 146 to prevent the heating of the fluid in the container 124 by thermal radiation. The dewar 122 is formed with a normally capped liquid fill port 152 which opens into the fluid containment space 142 so that the cryogenic fluid 126 may be reintroduced therein. The gas inlet port 128 is part of a gas inlet line 154 that opens into the fluid containment space 142. A pressure relief valve 156 formed in the top of the dewar 122 provide a vent for excess gas that may build up within the fluid containment space 142, to eliminate the possibility of an explosion.

The cooling module 130 receives gas from the fluid containment space 142 through a set of gas inlet openings 131 which are connected to a common manifold 160 that is mounted to a support platform 162 which extends from the base of the heating module 134. A filter 163 covers each of the gas inlet openings 131 so as to prevent contaminant flow therethrough. Gas flows through the gas inlet openings 131 and the manifold 160 into a gas intake line 164 connected to the module 160. A heat exchanger 166, located immediately above the bottom of the fluid containment space 142, is connected to the gas intake line 164 so as to receive the gas therefrom and cool it to a temperature at or slightly above that of the cryogenic fluid 126. The heat exchanger 166 comprises a number of small, thermally conductive tubes 168 that are shaped to form an elliptical helix. The heat exchanger tubes 168 are connected to the outlet line 132 so as to discharge the supercooled gas thereto. The outlet line 132 is contained within a vacuum jacket 169 and spaced apart therefrom so as to define a vacuum space 170 therebetween.

Gas flows from the outlet line 132 through a heating unit 172 in the heating module 134 where it may be heated to a selected temperature. The heating unit 172 includes a shell 174 the gas flows through, and a thermally conductive heat exchanger plug 176 inside the shell 174. Formed along the outer wall of the plug 176 are a number of grooves 178 arranged in a helical pattern through which the gas flows. The shell 174 and 176 are further dimensioned so as to form an inlet chamber 180 into which the gas initially flows from the outlet line 132, and a outlet chamber 182 from which it is discharged after it flows through the grooves 178. A temperature sensor 184 is located in the inlet chamber 180, and a temperature sensor 186 is located in the outlet chamber 182. Encased within the shell 174 are a set of electrically energizable heating elements 188 for heating the gas as it flows therethrough. Gas from the heating unit 172 is discharged through an outlet line 190 connected to the discharge chamber 182. The outlet coupling 138 is connected over the open end of the outlet line 190 for receiving the gas discharged therefrom so that it may be supplied to the line 140.

The heating unit 174 and outlet line 190, below the outlet coupling 138, are encased in a vacuum jacket 192 welded to the outer shell 144. The vacuum jacket 192 is spaced apart from the heating unit 174 and the outline line 190 to define a vacuum space 194 therebetween. The vacuum jacket 168 around the outlet line 132 is attached to the heating module's vacuum jacket 192 so that there is fluid communication between the outlet line vacuum space 170 and the heating module vacuum space 194. A vacuum port 196 is formed on the outside of the heating module vacuum jacket 192 to permit evacuation of vacuum spaces 170 and 194. Conductors 198, which carry signals from the temperature sensors 184 and 186 and current to the heating element 188, extend from terminals 200 on the outside of the heating module vacuum jacket 192 to the heating unit 174.

The cryogen supply system 120 is used by first filling the fluid container 124 with cryogenic fluid 126 to a level below the gas intake openings 131, and then supplying gas to the fluid containment space 142 through the gas port 128. The gas pressure that develops inside the fluid containment space 142 forces a fraction of the gas in the fluid containment space into the gas intake openings 131, through the gas intake manifold 160 and gas intake line 164 and into the heat exchanger 166. In the heat exchanger 166, the gas flows through the heat exchanger tubes 168 where it is cooled by thermal conduction to a temperature at or just above that of the cryogenic fluid 126 so that the gas becomes cryogenic. The cryogenic gas is discharged from the heat exchanger 166 through the outlet line 132 into the heating unit 174. A remote processor (not shown) connected to receive the signals from the temperature sensors 184 and 186, and control the energization of the heating elements 188 is used to monitor the temperature of the gas and can activate heating elements 188 to heat the gas flowing through the heating unit 174 to a selected temperature. The gas is then discharged from the cryogen supply system 122 through the outlet line 190.

The cryogen supply system 120 has many features of the cryogen supply system 10 (FIG. 1). The cryogen supply system is supplied with gas from an external source and cools the gas so that it is cryogenic. Thus, the system 120 can be used to provide cryogenic gas for extended period of time without interruption. The gas discharged from the cryogen supply system 120 flows through the heating module 134 where it may be heated prior to discharge so that the gas supplied by the system is at a temperature substantially above the gas in the dewar 122.

The cryogen supply system 100 can be used to supply very large amounts of gaseous state cryogen. For example, a cryogen supply system 100 having a fluid container 114 with a capacity of approximately 60 liters can be used to supply gaseous state cryogen at the rate of over 200 liters per minute for extended periods of time.

The illustrated embodiment of the cryogen supply system 10 is designed to provide only gaseous state cryogen. It will be readily apparent however that the liquid inlet, the manifold and the control valves of the cryogenic supply system 10 can be adapted to the system 120 so that it may also be used to supply both gaseous state cryogen and liquid state cryogen.

The foregoing detailed description has been limited to specific embodiments of the invention. It will be apparent, however, that variations and modifications can be made to this invention with the attainment of some or all of the advantages thereof. For example, the heating module of both the first and second embodiments of the invention are only needed if the user has desires to heat cryogen to a temperature above which is discharged from the dewar. Moreover, the requirement that the gas introduced into the fluid container have a composition identical to the cryogenic liquid therein is not absolute. Thus, in some instances it may be possible to cool gas with certain desirable characteristics with cryogenic liquid with other desirable characteristics. Therefore, it is the object of the appended claim to cover all such variations and modifications that come within the true spirit and scope of the invention.

What is claimed as new and desired to be secured by Letters Patent of the United States is:

1. A cryogen supply system comprising:

A. a fluid container for containing a volume of liquid cryogen, said fluid container having a gas region containing a gas in fluid communication with said liquid cryogen;

B. an outlet;

C. a cooling module positioned within said fluid container including a heat exchanger located in said fluid container so as to be normally immersed in said liquid cryogen and having a gas inlet positioned in said gas region and an exit connected to said outlet, to facilitate flow of gas from said gas region to said outlet through said heat exchanger to facilitate cooling of said gas by said liquid cryogen prior to being expelled through said outlet.

2. A cryogen supply system as defined in claim 1 further comprising:

A. an exterior housing external to said fluid container, the volume between said exterior housing and said fluid container defining a vacuum space, said exterior housing having a vacuum port to facilitate evacuation of said vacuum space;

B. a radiation shield exterior to said fluid container and interior to said exterior housing to shield said fluid container from thermal radiation; and C. support means for supporting said radiation shield within said exterior housing in spaced apart relation.

3. A cryogen supply system as defined in claim 2 further comprising:

A. a fluid chamber support for supporting said fluid chamber within said exterior housing;

B. a fluid input tube extending from the interior of said fluid chamber through said exterior housing for facilitating the introduction of liquid cryogen into said fluid chamber from outside said exterior housing; and C. a gas input tube extending from the gas region of said fluid container through said exterior housing for facilitating the introduction of gas into said gas region to, in turn, facilitate the forcing the flow of gas into said gas inlet and through said cooling module.

4. A cryogen supply system as defined in claim 3 wherein said cooling module further comprises:

A. a gas control valve for controlling the flow of gas between said heat exchanger and said exit to facilitate flow of gas from said gas region to said outlet through said heat exchanger to facilitate cooling of said gas by said liquid cryogen; and B. a liquid transfer element comprising a liquid input positioned in said liquid cryogen and a liquid control valve for controlling the flow of liquid cryogen between said liquid input and said exit.

5. A cryogen supply system as defined in claim 4 further comprising:

A. a gas valve control means extending from said gas control valve through said exterior housing for facilitating the control of said gas control valve; and B. A liquid valve control means extending from said liquid control valve through said exterior housing for facilitating the control of said liquid control valve.

6. A cryogen supply system as defined in claim 1 further comprising a gas inlet for facilitating the input of gas into said gas region of said fluid container to thereby force the flow of gas into said gas inlet and through said cooling module.

7. A cryogen supply system as defined in claim 1 wherein said heat exchanger comprises a tubular heat conductive helix of a formed within an elongated ring of thermally-conductive material.

8. A cryogen supply system as defined in claim 1 wherein said gas input comprises a filter for filtering contaminants from said gas prior to its flowing into the heat exchanger.

9. A cryogen supply system comprising:

A. a fluid container for containing a volume of liquid cryogen, said fluid container having a gas region containing a gas in fluid communication with said liquid cryogen;

B. an outlet;

C. a cooling module positioned within said fluid container comprising:

i. a heat exchanger located in said fluid container so as to be normally immersed in said liquid cryogen;

ii. a gas inlet positioned in said gas region for facilitating flow of gas from said gas region to said heat exchanger;

iii. an exit connected to said outlet;

iv. a gas control valve for controlling the flow of gas between said heat exchanger and said exit to facilitate flow of gas from said gas region to said outlet through said heat exchanger to facilitate cooling of said gas by said liquid cryogen; and v. a liquid transfer element comprising a liquid input positioned so as to be normally immersed in said liquid cryogen and a liquid control valve for controlling the flow of liquid cryogen between said liquid input and said exit.

10. A cryogen supply system comprising:

A. a fluid container for containing a volume of liquid cryogen, said fluid container having a gas region containing a gas in fluid communication with said liquid cryogen;

B. a fluid outlet;

C. a cooling module positioned within said fluid container including a heat exchanger located in said fluid container so as to be normally immersed in said liquid cryogen and having a gas inlet positioned in said gas region and an exit connected to said outlet, to facilitate flow of gas from said gas region to said outlet through said heat exchanger and therefrom to said outlet, to facilitate cooling of said gas by said liquid cryogen prior to being expelled through said fluid outlet; and D. a controllable heater connected to said outlet for controllably heating the gas expelled through said outlet.

11. A cryogen supply system a defined in claim 10 wherein said heater comprises:

A. a conduit having a heater inlet connected to said fluid outlet, a heater outlet and means defining a passageway between said heater inlet and said heater outlet, said gas flowing from said fluid outlet through said heater inlet, said passageway and expelled through said heater outlet; and B. controllable heating means situated exteriorly of said conduit in thermal contact therewith for heating said conduit to thereby heat the interior of said passageway.

12. A cryogen supply system as defined in claim 11 in which said conduit includes:

A. an exterior cylinder in thermal contact with said heating means and having an interior surface;

B. an interior cylinder situated interiorly of said exterior cylinder and having a groove defined in its exterior surface for defining, in combination with the interior surface of said exterior cylinder, said passageway.

13. A cryogen supply system as defined in claim 12 in which said groove in said interior cylinder is helical, thereby defining a helical passageway.

14. A cryogen supply system as defined in claim 11 further comprising thermal sensing means proximate said conduit responsive sensing the temperature of said gas passing therethrough and temperature control means responsive to said thermal control means for controlling said heating means.

15. A cryogen supply system comprising:

A. a fluid container for containing a volume of liquid cryogen, said fluid container having a gas region containing a gas in fluid communication with said liquid cryogen;

B. an exterior housing external to said fluid container, the volume between said exterior housing and said fluid container defining a vacuum space, said exterior housing having a vacuum port to facilitate evacuation of said vacuum space;

C. a radiation shield exterior to said fluid container and interior to said exterior housing to shield said fluid container from thermal radiation;

D. support means for supporting said radiation shield within said exterior housing in spaced apart relation;

E. a fluid chamber support for supporting said fluid chamber within said exterior housing;

F. a fluid input tube extending from the interior of said fluid chamber through said exterior housing for facilitating the introduction of liquid cryogen into said fluid chamber from outside said exterior housing; and G. a gas input tube extending from the gas region of said fluid container through said exterior housing for facilitating the introduction of gas into said gas region to, in turn, facilitate the forcing the flow of gas into said gas inlet and through said cooling module;

H. a gas inlet for facilitating the input of gas into said gas region of said fluid container to thereby force the flow of gas into said gas inlet and through said cooling module;

I. an outlet; and

J. a cooling module positioned within said fluid container comprising:

i. a heat exchanger comprising a tubular heat conductive helix formed within an elongated ring of thermally-conductive material positioned in said liquid cryogen located in said fluid container so as to be normally immersed in said liquid cryogen;

ii. a gas inlet positioned in said gas region for facilitating flow of gas from said gas region to said heat exchanger;

iii. an exit connected to said outlet;

iv. a gas control valve for controlling the flow of gas between said heat exchanger and said exit to facilitate flow of gas from said gas region to said outlet through said heat exchanger to facilitate cooling of said gas by said liquid cryogen; and v. a liquid transfer element comprising a liquid input positioned so as to be normally immersed in said liquid cryogen and a liquid control valve for controlling the flow of liquid cryogen between said liquid input and said exit K. a gas valve control means extending from said gas control valve through said exterior housing for facilitating the control of said gas control valve; and L. a liquid valve control means extending from said liquid control valve through said exterior housing for facilitating the control of said liquid control valve.

16. A cryogen supply system comprising:

A. a fluid container for containing a volume of liquid cryogen, said fluid container having a gas region containing a gas in fluid communication with said liquid cryogen;

B. an exterior housing external to said fluid container, the volume between said exterior housing and said fluid container defining a vacuum space, said exterior housing having a vacuum port to facilitate evacuation of said vacuum space;

C. a radiation shield exterior to said fluid container and interior to said exterior housing to shield said fluid container from thermal radiation;

D. support means for supporting said radiation shield within said exterior housing in spaced apart relation;

E. a fluid chamber support for supporting said fluid chamber within said exterior housing:

F. a fluid input tube extending from the interior of said fluid chamber through said exterior housing for facilitating the introduction of liquid cryogen into said fluid chamber from outside said exterior housing; and G. a gas input tube extending from the gas region of said fluid container through said exterior housing for facilitating the introduction of gas into said gas region to, in turn, facilitate the forcing the flow of gas into said gas inlet and through said cooling module;

H. a gas inlet for facilitating the input of gas into said gas region of said fluid container to thereby force the flow of gas into said gas inlet and through said cooling module;

I. an outlet; and

J. a cooling module positioned within said fluid container comprising:

i. a heat exchanger comprising a tubular heat conductive helix formed within an elongated ring of thermally-conductive material located in said fluid container so as to be normally immersed in said liquid cryogen;

ii. a gas inlet positioned in said gas region for facilitating flow of gas from said gas region to said heat exchanger;

iii. an exit connected to said outlet;

iv. a gas control valve for controlling the flow of gas between said heat exchanger and said exit to facilitate flow of gas from said gas region to said outlet through said heat exchanger to facilitate cooling of said gas by said liquid cryogen; and v. a liquid transfer element comprising a liquid input positioned so as to be normally immersed in said liquid cryogen and a liquid control valve for controlling the flow of liquid cryogen between said liquid input and said exit;

K. a gas valve control means extending from said gas control valve through said exterior housing for facilitating the control of said gas control valve;

L. a liquid valve control means extending from said liquid control valve through said exterior housing for facilitating the control of said liquid control valve; and M. a controllable heater connected to said outlet for controllably heating the gas expelled through said outlet, comprising:

i. a conduit having a heater inlet connected to said fluid outlet, a heater outlet and means defining a helical passageway between said heater inlet and said heater outlet, comprising:

a. an exterior cylinder in thermal contact with said heating means and having an interior surface;

b. an interior cylinder situated interiorly of said exterior cylinder and having a helical groove defined in its exterior surface for defining, in combination with the interior surface of said exterior cylinder, said passageway ii. controllable heating means situated exteriorly of said conduit in thermal contact therewith for heating said conduit to thereby heat the interior of said passageway;

iii. thermal sensing means proximate said conduit for sensing the temperature of said gas passing therethrough; and iv. temperature control means responsive to said thermal control means for controlling said heating means.

* * * * *